US010196793B2

(12) United States Patent
White

(10) Patent No.: US 10,196,793 B2
(45) Date of Patent: Feb. 5, 2019

(54) SYSTEMS AND METHODS TO PROVIDE PRESSED AND AGGREGATE FILLED CONCAVITIES FOR IMPROVING GROUND STIFFNESS AND UNIFORMITY

(71) Applicant: Ingios Geotechnics, Inc., Northfield, MN (US)

(72) Inventor: David J. White, Boone, IA (US)

(73) Assignee: Ingios Geotechnics, Inc., Northfield, MN (US)

( * ) Notice: Subject to any disclaimer, the term of this patent is extended or adjusted under 35 U.S.C. 154(b) by 0 days.

(21) Appl. No.: 15/441,794

(22) Filed: Feb. 24, 2017

(65) Prior Publication Data

US 2017/0241098 A1 Aug. 24, 2017

Related U.S. Application Data

(60) Provisional application No. 62/299,281, filed on Feb. 24, 2016.

(51) Int. Cl.

| | |
|---|---|
| ***E02D 3/12*** | (2006.01) |
| ***E02F 9/20*** | (2006.01) |
| *E01C 19/23* | (2006.01) |
| *E01C 19/38* | (2006.01) |
| *E02F 9/22* | (2006.01) |

(Continued)

(52) U.S. Cl.

CPC ..... *E02D 3/12* (2013.01); *E02D 3/123* (2013.01); *E02F 9/2004* (2013.01); *E01C 19/23* (2013.01); *E01C 19/38* (2013.01); *E02D 2200/1607* (2013.01); *E02D 2200/1671* (2013.01); *E02D 2250/003* (2013.01); *E02D 2250/0007* (2013.01); *E02D 2300/0079* (2013.01);

(Continued)

(58) Field of Classification Search

CPC ..... E02D 3/08; E02D 3/123

See application file for complete search history.

(56) References Cited

U.S. PATENT DOCUMENTS 5,249,892 A 10/1993 Fox et al.
6,354,766 B1 * 3/2002 Fox ..... E02D 3/08 405/232

(Continued)

FOREIGN PATENT DOCUMENTS

| | | | |
|---|---|---|---|
| EP | 1382750 | A1 | 1/2004 |
| WO | 2008-088172 | A1 | 7/2008 |
| WO | 2011001297 | A1 | 1/2011 |

OTHER PUBLICATIONS

International Search Report and Written Opinion for International Application No. PCT/US2017/019355 dated Jun. 7, 2017 (eighteen (18) pages).

(Continued)

*Primary Examiner* — Frederick L Lagman

(74) *Attorney, Agent, or Firm* — Olive Law Group, PLLC

(57) ABSTRACT

Systems and methods to provide pressed aggregate-filled cavities for improving ground stiffness and uniformity are disclosed. According to an aspect, a method includes using a mechanism to press into a ground surface in a substantially downward direction to create a concavity. The method also includes substantially or completely filling the concavity with unstabilized or chemically stabilized aggregate, soil, or sand. Further, the method includes using the mechanism to press the aggregate within the concavity to achieve a desired ground stiffness.

32 Claims, 16 Drawing Sheets

(51) Int. Cl.
*E02F 3/96* (2006.01)
*E02F 5/20* (2006.01)

(52) U.S. Cl.
CPC ..... *E02D 2600/40* (2013.01); *E02F 3/967* (2013.01); *E02F 5/20* (2013.01); *E02F 9/2271* (2013.01)

(56) References Cited

U.S. PATENT DOCUMENTS 6,354,768 B1* 3/2002 Fox ..... E02D 3/02 405/238
2007/0077128 A1* 4/2007 Wissmann ..... E02D 3/046 405/232
2008/0044237 A1 2/2008 Okita
2008/0101873 A1* 5/2008 Fox ..... E02D 3/08 405/239
2008/0159813 A1* 7/2008 Wissmann ..... E02D 3/08 405/232
2009/0290940 A1* 11/2009 Martin, Sr. ..... E02D 3/123 405/232
2009/0311050 A1 12/2009 Martin, Sr.
2010/0028087 A1* 2/2010 Wissmann ..... E02D 3/02 405/240
2010/0329798 A1* 12/2010 Maher ..... E02D 3/046 405/271
2011/0064526 A1* 3/2011 White ..... E02D 3/08 405/245
2011/0243666 A1* 10/2011 Fox ..... E02D 3/08 405/232
2012/0163922 A1* 6/2012 Wissmann ..... E02D 3/02 405/240
2012/0183361 A1* 7/2012 Maher ..... E02D 3/046 405/271
2014/0270985 A1* 9/2014 Maher ..... E02D 3/046 405/271
2015/0330051 A1* 11/2015 White ..... E02D 27/18 405/249

OTHER PUBLICATIONS

International Preliminary Report on Patentability and Written Opinion issued in counterpart PCT Application No. PCT/US2017/019355 dated Aug. 28, 2018 (Sixteen (16) pages).

* cited by examiner

| Parameter | Untreated | PAC | PAC Improvement Ratio |
|---|---|---|---|
| DCP Penetration Resistance | 65 mm/blow | 17 mm/blow | 3.8 |
| Average CBR | 0.9 | 13.9 | 15.4 |
| # cycles at 2 in. rut (from power modeling) | 18 | 12,251 | 645 |
| Mr @ 1000 cycles or @ 2.0 in. deformation if less than 1000 cycles | 4,398 psi | 16,027 psi | 3.6 |

FIG. 11

SYSTEMS AND METHODS TO PROVIDE PRESSED AND AGGREGATE FILLED CONCAVITIES FOR IMPROVING GROUND STIFFNESS AND UNIFORMITY

CROSS REFERENCE TO RELATED APPLICATION

This application claims priority to U.S. Provisional Patent Application No. 62/299,281, filed Feb. 24, 2016, and titled SYSTEMS AND METHODS TO PROVIDE PRESSED AND AGGREGATE FILLED CONCAVITIES FOR IMPROVING GROUND STIFFNESS AND UNIFORMITY, the content of which is incorporated herein by reference in its entirety.

TECHNICAL FIELD

The subject matter disclosed herein relates to ground improvement for shallow depths. Particularly, the subject matter disclosed herein relates to systems and methods to provide pressed and/or aggregate-filled concavities for improving the stiffness and spatial uniformity of stiffness for natural ground, pavement foundation systems, railway track bed systems, and the like.

BACKGROUND

Shallow ground improvement, such as less than about 6 feet, is often required when weak or non-uniform subgrade conditions exist. Various techniques and systems have been developed to improve natural ground, pavement foundation, and track bed stiffness values such as chemical stabilization using cement and lime, burying geogrid reinforcement within fill layers, or building up compacted layers of stiffer aggregate. These techniques typically offer treatment depths of less than 1 foot and do not directly build in the desired stiffness while accounting for spatial non-uniformity of stiffness.

By improving stiffness and uniformity, ground can be improved to provide more uniformity support overlying structures and fill, pavement systems can be optimized to reduce pavement layer thickness and long-term pavement performance problems, and railroad track bed can be improved to reduce rail deflections and re-ballasting maintenance. Accordingly, there is continuing need for better and more efficient systems and techniques for improving natural ground, pavement foundation, and track bed stiffness and the associated spatial uniformity of stiffness.

SUMMARY

Described herein are systems and methods to provide pressed aggregate-filled concavities for improving ground, pavement foundation, and railway track bed stiffness values and the associated spatial stiffness uniformity. In an example, systems and methods disclosed herein provide a commercially viable technique to improve non-uniform and low stiffness layers.

According to an aspect, a method includes using a mechanism to press into a ground surface in a substantially downward direction under controlled loading to create a concavity. The depth of the concavity is controlled by the selected downward force or target penetration depth, and the corresponding penetration resistance offered by the foundation materials. The penetration depth is comparatively greater for weaker ground using controlled force loading.

The method also includes substantially or completely filling the concavity with unstabilized or chemically stabilized aggregate, soil, or sand or said materials with a chemical modifier (e.g., polymer, cement). Further, the method includes using the mechanism to press the aggregate within the concavity using a controlled downward force or penetration depth and pressing duration (amount of time the controlled downward force is maintained during the pressing action).

According to another aspect, a method includes using a plurality of mechanisms to press into different portions of a ground surface in substantially downward directions to create a plurality of concavities. The depth of each individual concavity can be controlled by the penetration resistance offered at that location of the individual pressing tool, such that the penetration depths of the plurality of mechanisms are independent of one another. The method also includes substantially or completely filling the concavities with unstabilized or chemically stabilized aggregate, soil, or sand or said materials with a chemical modifier (e.g., polymer, cement). Further, the method includes using the mechanisms to press the aggregate, soil, or sand within the concavities using controlled force or penetration depth.

According to another aspect, a system includes multiple mandrels configured to be moved in a downward direction. The system also includes a support configured to carry the mechanisms. Further, the mechanism includes a mechanism attached to the support and mandrels. The mechanism can move the mandrels in the downward direction.

According to another aspect, a system includes a delivery mechanism for efficiently filling the concavities with selected materials. The system also includes an adjustable skid system for pulling the device across the ground and a plow mechanism to prepare the improved ground with a flat surface in preparation for subsequent construction operations.

According to another aspect, a method includes using a mandrel advanced into the ground under constant penetration rate (e.g., 1 inch per second) and measuring the corresponding force to determine the ground penetration resistance versus depth. Ground penetration resistance versus depth results provide information for selecting target penetration force and penetration depth settings.

BRIEF DESCRIPTION OF THE DRAWINGS

The present disclosure can be better understood by referring to the following figures. The components in the figures are not necessarily to scale, emphasis instead being placed upon illustrating the principles of the present disclosure. In the figures, like reference numerals designate corresponding parts throughout the different views.

FIG. 11 is a table that compares testing results of an untreated ground surface and a pressed aggregate-filled ground surface;

DETAILED DESCRIPTION

The presently disclosed subject matter is described herein with specificity to meet statutory requirements. However, the description itself is not intended to limit the scope of this patent. Rather, the inventor has contemplated that the claimed subject matter might also be embodied in other ways, to include different steps, materials or elements similar to the ones described in this document, in conjunction with other present or future technologies. Moreover, although the term "step" may be used herein to connote different aspects of methods employed, the term should not be interpreted as implying any particular order among or between various steps herein disclosed unless and except when the order of individual steps is explicitly described.

Embodiments of the present disclosure include systems and methods to provide pressed and/or aggregate-filled concavities for improving the stiffness and/or spatial uniformity of stiffness for natural ground, pavement foundation systems, railway track bed systems, and the like. For example, such systems and methods can be used to improve elastic modulus, resilient modulus, modulus of subgrade reaction, track modulus, and the like.

Figure 1:
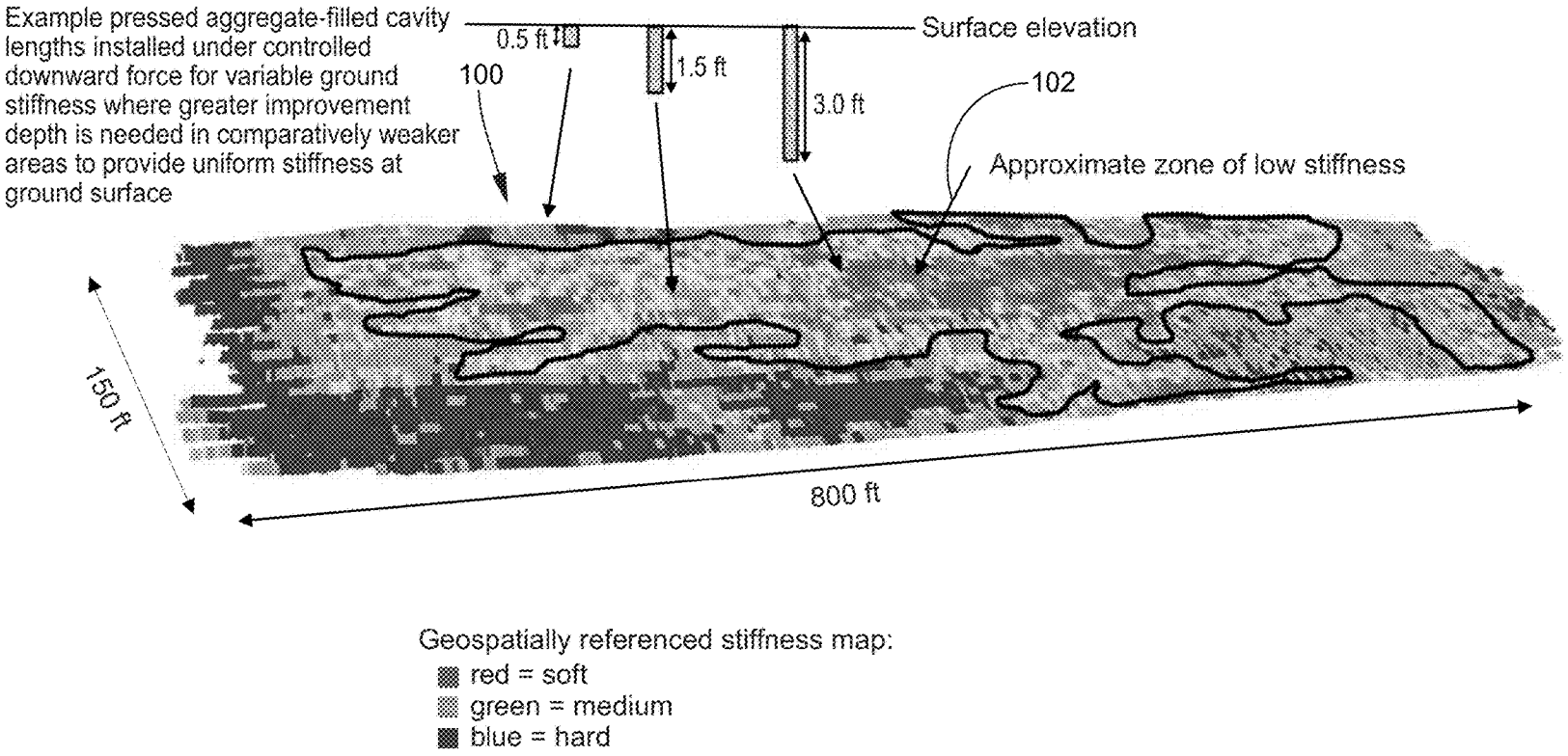
FIG. 1 is an image of a geospatially-referenced stiffness map of an example pavement foundation layer or natural subgrade to which the presently disclosed subject matter may be applied where the stiffness map indicates spatial non-uniformity in stiffness.

FIG. 1 illustrates an image of an example geospatially-referenced stiffness map of an example pavement foundation layer or subgrade 100 to which the presently disclosed subject matter may be applied. The figure also includes various notations about the image. Referring to FIG. 1, the outlined area (indicated by reference arrow 102) are low stiffness or unstable areas of the subgrade. The presently disclosed subject matter may be applied to this area 102 in order to improve stiffness and uniformity across the subgrade 100. As illustrated, the depth of the pressed aggregate-filled concavities can be greater in the lower stiffness areas compared to the higher stiffness areas using controlled downward force as applied in accordance with the present disclosure.

Figure 2C:
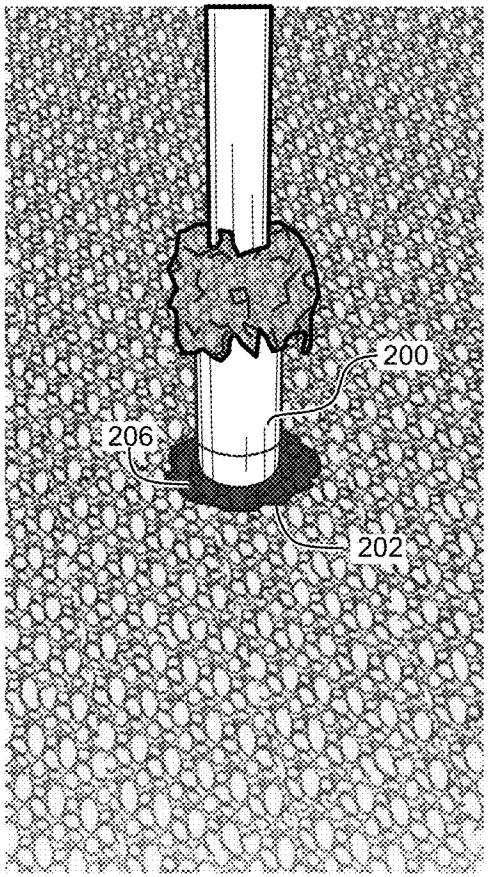
FIGS. 2A-2C are images showing steps in an example method for pressing and filling concavities in accordance with embodiments of the present disclosure.
Figure 2B:
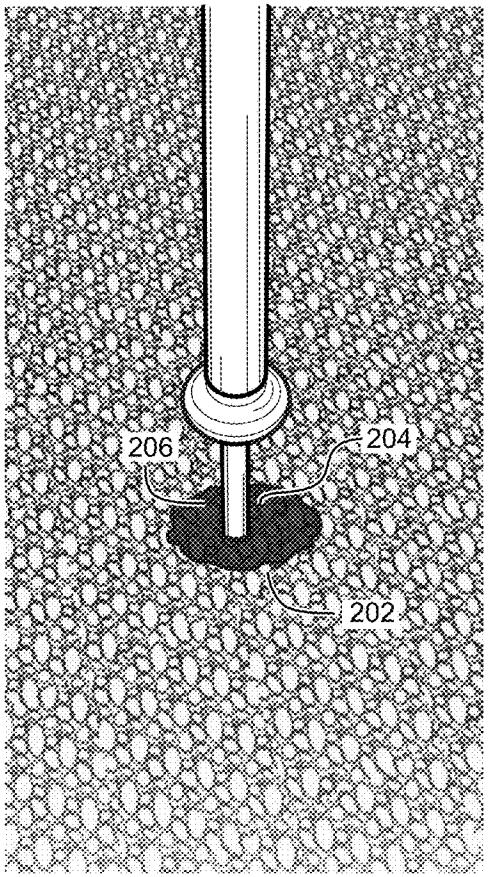
Figure 2A:
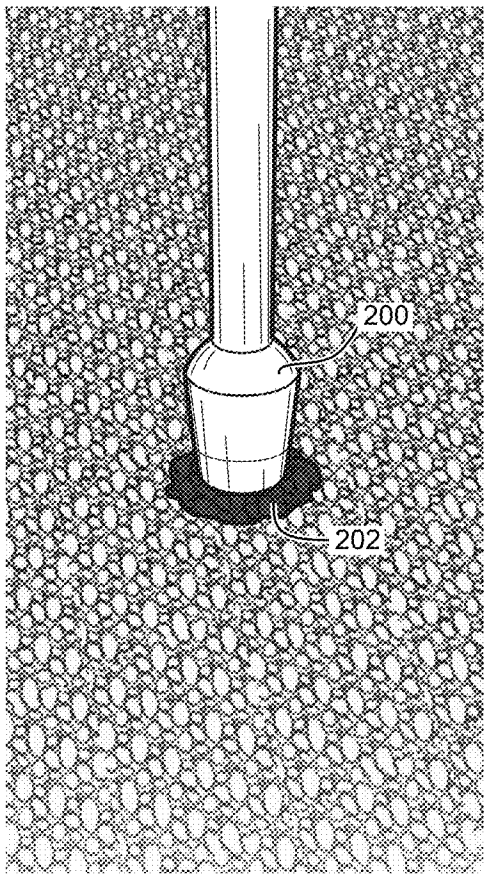

FIGS. 2A-2C are images showing steps in an example method for pressing and filling concavities in accordance with embodiments of the present disclosure. Referring to FIG. 2A, the figure shows a step of a mandrel 200 being pushed into a ground surface 202 under controlled pressure to create a concavity 204. FIG. 2B shows the mandrel 202 being retracted to allow aggregate 206 to fill the concavity 204. FIG. 2C shows the mandrel 202 being reinserted to press the aggregate 206 into the concavity 204 under controlled pressure. The steps shown in FIGS. 2A-2C may be repeated until the mandrel 200 does not penetrate (i.e., settle) under the controlled downward load near the top of the subgrade or aggregate base layer.

It is noted that natural ground, pavement foundations, and railway track beds with weak and isolated soft areas cause differential settlement. For pavement systems, differential settlement can lead to stress concentration in the pavement layer, thus reducing pavement fatigue life and reducing pavement ride quality. The presently disclosed subject matter provides techniques to improve the shallow subsurface pavement foundation conditions to meet pavement design support requirements (e.g., achievement of a minimum stiffness value and spatially uniformity of stiffness). For railway track beds, differential and excessive settlement lead to high bending stresses and fatigue in the track rails and causing a reduction in speed for the rail system. Improvement of the weak and isolated soft areas can be done on a spatially near-continuous basis or in isolated regions of interest based on predetermined geospatial areas that require improvement, such as determined from near-continuous stiffness-based testing or haul truck proof rolling where wheel ruts identify weak areas.

An example method of improvement involves pressing multiple, sequenced mandrels downward through a pre-constructed surface layer of loose or compacted aggregate (e.g., between about 4 and 18 inch thick layer with nominal aggregate size of between about 0.5 and 4 inches) into the underlying soft subgrade soils to a depth of between about 6 and 48 inches to create concavities that can be filled with stiffer materials (e.g., aggregate). In embodiments of the present disclosure, the tool used to form the concavities and subsequently press aggregate into the concavities can have any suitable shape such as, but not limited to, a flat circular plate, a square plate, or the like, or any other suitable shap. In other embodiments, the shape can be spherical or near spherical in shape. In yet another embodiment, the shape can be a mandrel having an end that is open with straight or tapered (geometry of conical frustum with narrowing diameter toward the top) that has a length of between about 6 inches and about 18 inches or any other suitable length. Whereby pressing of an open-ended pipe can cut into and receive materials within the hollow sectioned of the mandrel. After advancing the mandrel to the desired depth, the material contained inside the hollow pipe section can be deposited at that depth in the concavity upon withdrawing the mandrel. This approach can have advantages when suitable quality material at the surface can be pushed downward and deposited at a deeper profile of softer ground.

A concavity can be created when a mandrel is pressed into the ground as described herein. The concavity can be filled with aggregate or chemically stabilized soil, sand, or aggregate and subsequently compacted with a suitable compaction methods (smooth drum roller, vibratory plate compactor, pneumatic compaction). Alternatively, the filled concavities can be re-pressed with the concavity forming mandrel. The concavities can be closely spaced (e.g., between about 12 and 36 inches on center) and depend on the site conditions, aggregate, and mandrel tool geometry, and penetration resistance of the foundation materials, level of improvement desired, and the need to control resulting stress concentrations in the overlying pavement or layers.

In accordance with embodiment, the diameter of the mandrel tool can be between about 3 inches and about 12 inches, or any other suitable dimension. The pressing mechanism can be a pressure-controlled hydraulic actuator and can include position feedback control. More than one mandrel tool can be configured as described herein. The delivery mechanism for this technology may be one or more pressing tool hydraulic actuators mounted on a tractor attachment. By integrating pressure and deflection sensors and a feedback control system into the pressing tool system, the level of improvement can be directly monitored and controlled to determine the required penetration depth and pressing force. By setting the pressing force to a selected target value and monitoring deflection while pressing the mandrel(s) downward, the stiffness can be controlled and calculated (applied force or pressure divided by the displacement). By using the system to both install the pressed aggregate-filled concavities and measure the ground stiffness, the desired stiffness and uniformity can be determined and controlled. If sufficient modulus is not reached, the pressing tool can hold the pressing load for a specified duration to consolidate the ground, can repress with additional aggregate flowing into the concavity before re-pressing, and/or can increase the downward pressing force or penetration depth. Both the penetration force and depth can be selected from using the mandrel advanced into the ground under constant penetration rate (e.g., 1 inch per second) and corresponding penetration resistance versus depth. For example, ground penetration resistance showing a lower stiff layer can be used to set a target minimum penetration depth, or penetration force measurements at a stiff bearing layer can be used to set a maximum penetration force to ensure the mandrel does not penetrate the layer.

An example benefit of the present disclosure is that shallow improvement can reduce construction costs associated with over-excavation and replacement. Further, an example benefit is that marginal and non-uniform natural ground, pavement foundations, and railway track beds can be upgraded to higher stiffness and more uniform foundations. Higher stiffness foundations can improve pavement and track performance and can reduce future maintenance costs.

The process of treating selected regions to improve and control spatial uniformity of stiffness based on geospatially referenced stiffness maps that indicate variable foundation stiffness is a novel concept.

To improve further composite stiffness and uniformity of stiffness of the improved ground after installing pressed aggregate-filled concavities, the improved area can be covered with a layer of aggregate (e.g., thickness of about 6 inches), stabilized soil/aggregate, and/or geosynthetic reinforced aggregate. The coverings can be configured to reduce stress concentration at the bottom of the subsequent pavement layer or other overlying layers/materials.

In embodiments, the pressed aggregate-filled concavity machine system can be a combination of cylinders, hydraulic pressure control equipment, up-down motion, aggregate flow, connection to machine, skid system, adjustable holes, dragging motion with skid to level the ground, and housing to contain aggregate with adapters to allow aggregate flow out the bottom of the housing box.

Figure 3A:
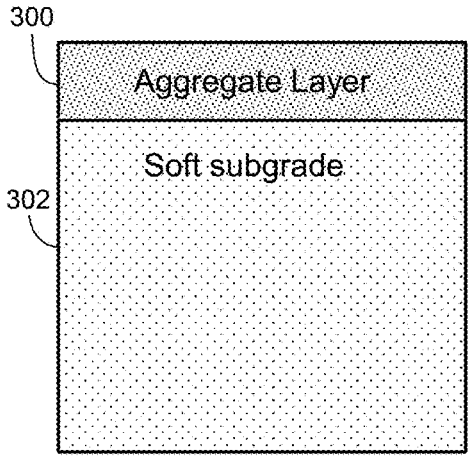
FIGS. 3A-3E illustrates example steps in a construction process in accordance with embodiments of the present disclosure.
Figure 3B:
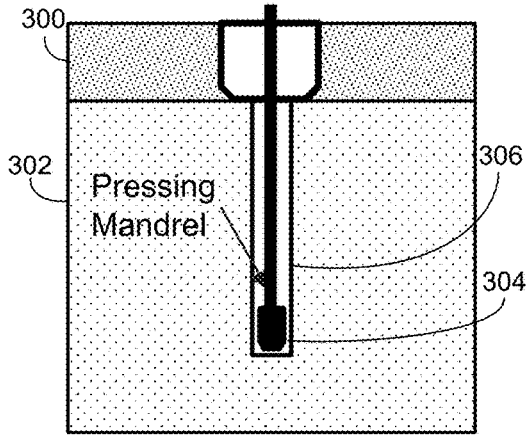
Figure 3C:
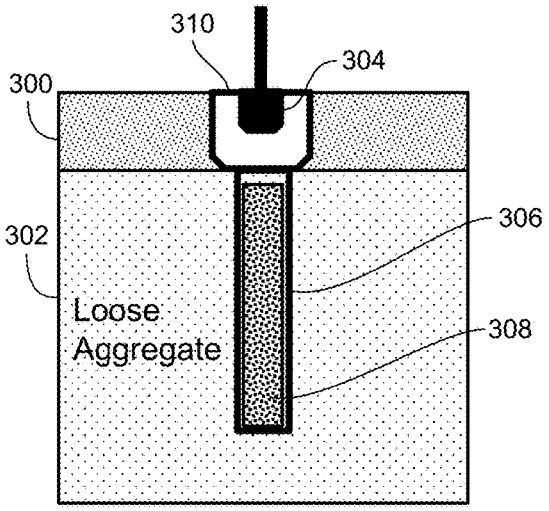
Figure 3D:
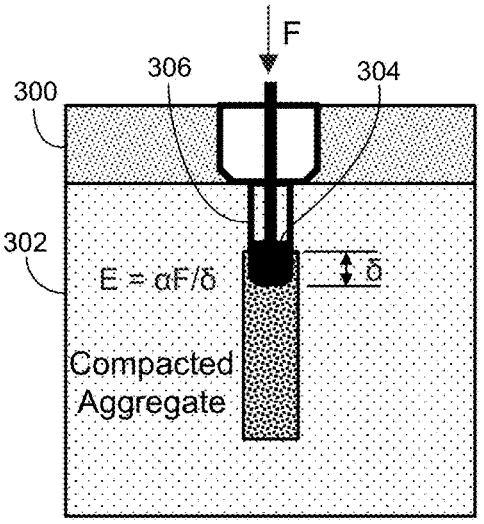
Figure 3E:
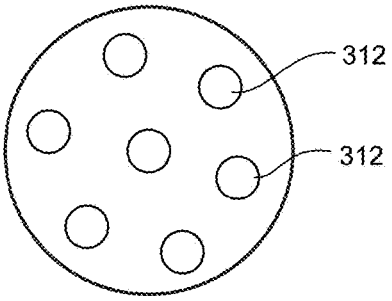

FIGS. 3A-3E illustrate example steps in a construction process in accordance with embodiments of the present disclosure. In each figure, a cross-section of an aggregate layer 300 and a soft subgrade 302 are shown to depict their interaction tools in a technique in accordance with embodiments of the present disclosure. Referring to FIG. 3A, the aggregate layer 300 may be placed over the subgrade 302 as shown. Alternatively, there may be soft subgrade material provide in a first step. FIG. 3B shows a pressing tool 304, particularly a mandrel, forming a concavity 306 in the subgrade 302. Any suitable mechanism may be used in place of a pressing tool. In this example, the diameter of the concavity 305 is larger in the aggregate layer 300 than the subgrade 302. At FIG. 3C, the pressing tool 304 is lifted such that loose aggregate 308 is allowed to flow down an open hole 310 into the concavity. At FIG. 3D, the pressing tool 304 is pushed downward until a target downward force is achieved while monitoring deflection, or the application of downward force F is repeated until the target downward force is achieved. A suitable control system can ensure the minimum stiffness is achieved, thus the pier stiffness is specifically controlled as part of the construction process. FIG. 3E shows a top view of a result of the process with seven cavities 312 being filled with aggregate. Particularly in FIG. 3E, the result can be multiple pressed aggregate-filled concavities 312 closely spaced that improve the composite vertical stiffness, reduce permanent deformation, and improve spatial uniformity by nature of the system building in the target stiffness using controlled force, displacement, and/or loading duration.

Figure 4:
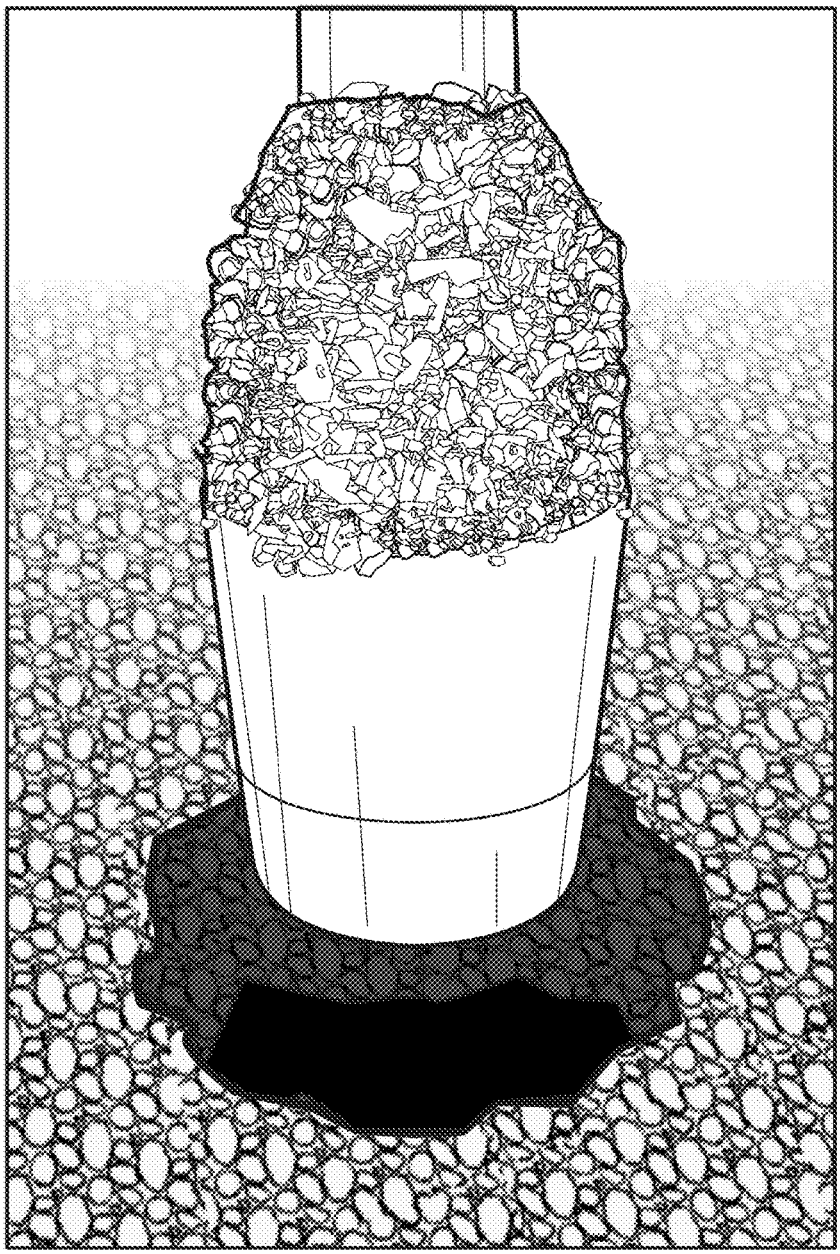
FIG. 4 is an image showing a mechanism for pressing into a ground surface in accordance with embodiments of the present disclosure.

FIG. 4 is an image showing a mechanism, or pressing tool, for pressing into a ground surface in accordance with embodiments of the present disclosure. Particularly, the figure shows a 4 inch mandrel head in position over a concavity.

Figure 5:
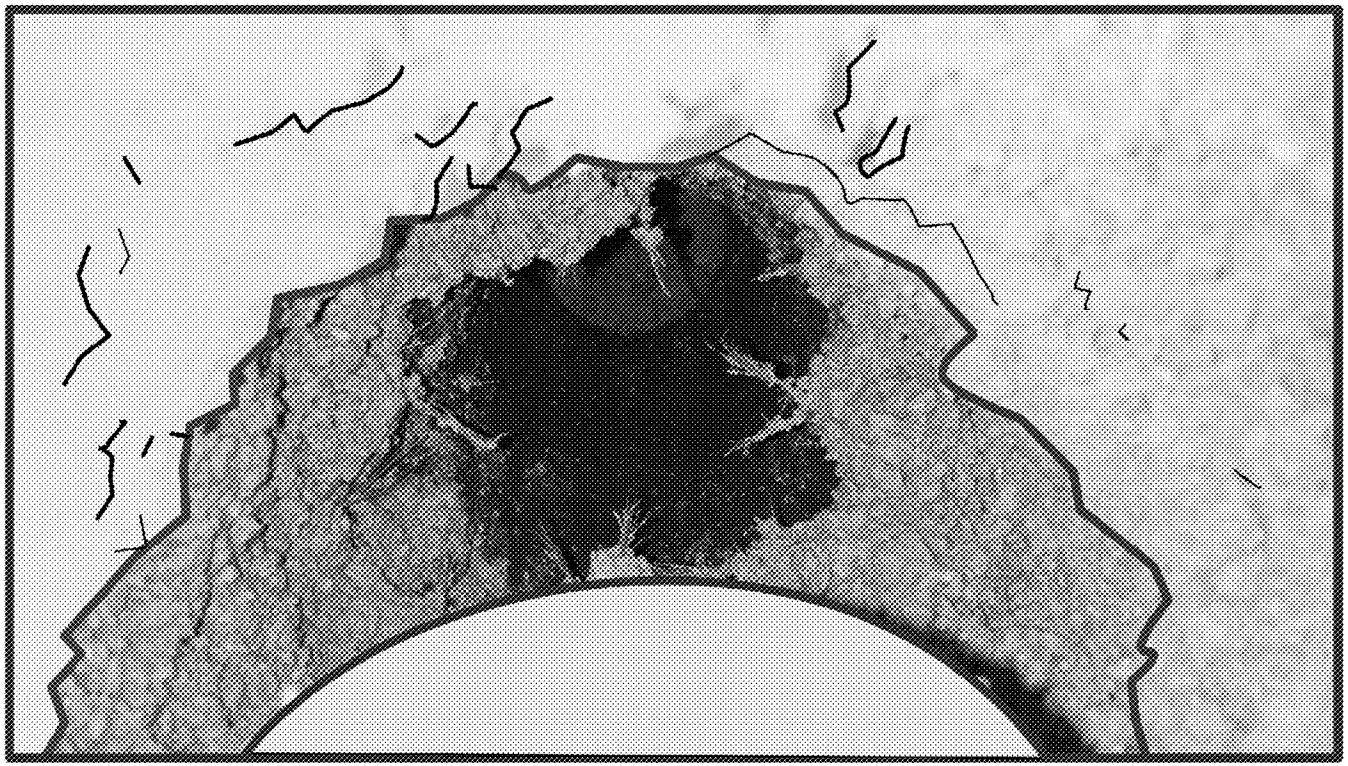
FIG. 5 is an image showing a view down into a concavity after one push and retraction of a mandrel into ground in accordance with embodiments of the present disclosure.

FIG. 5 is an image showing a view down into a concavity after one push and retraction of a mandrel into ground in accordance with embodiments of the present disclosure.

Figure 6B:
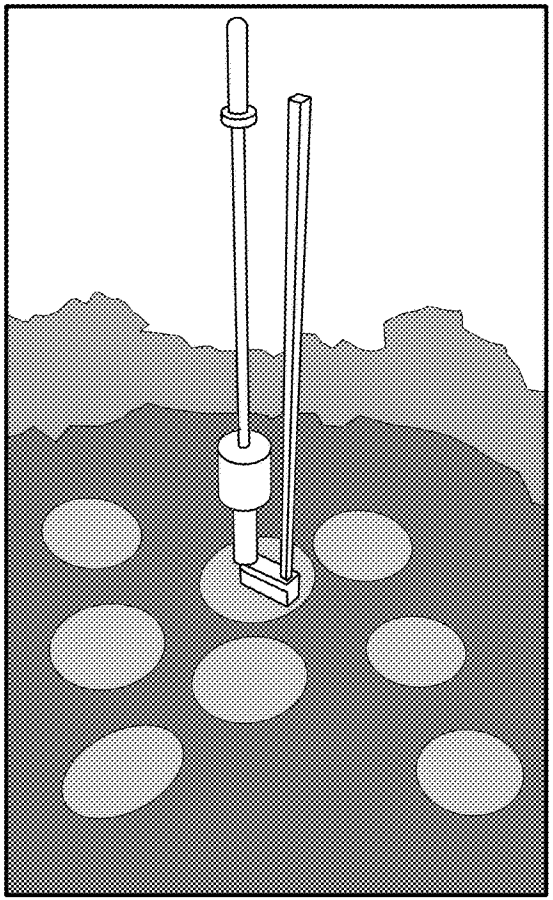
FIGS. 6A and 6B are images showing exposed pressed aggregate-filled concavities after removal of a surface aggregate layer.
Figure 6A:
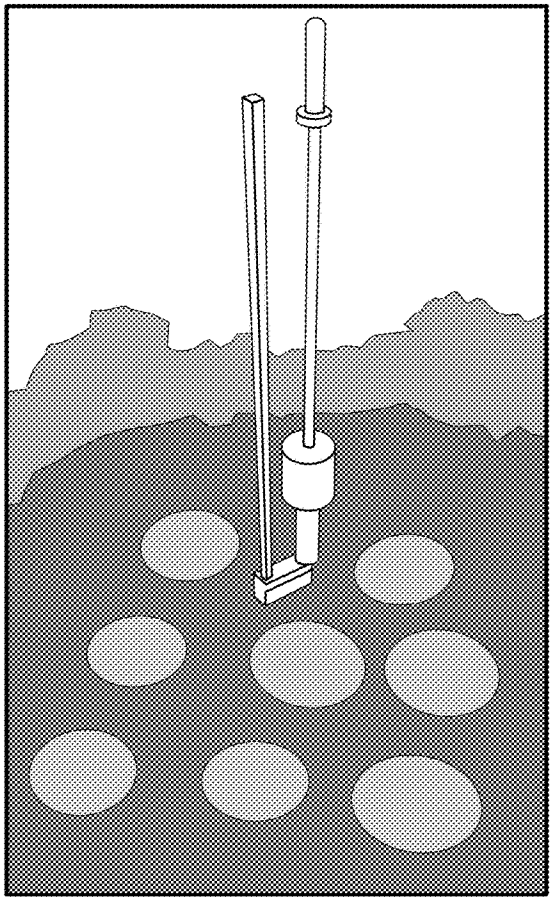

FIGS. 6A and 6B are images showing exposed pressed aggregate-filled concavities after removal of a surface aggregate layer. More particularly, FIG. 6A shows a dynamic cone penetration (DCP) test in matrix soil. FIG. 6B shows DCP test in pressed aggregate-filled concavities.

Figure 7A:
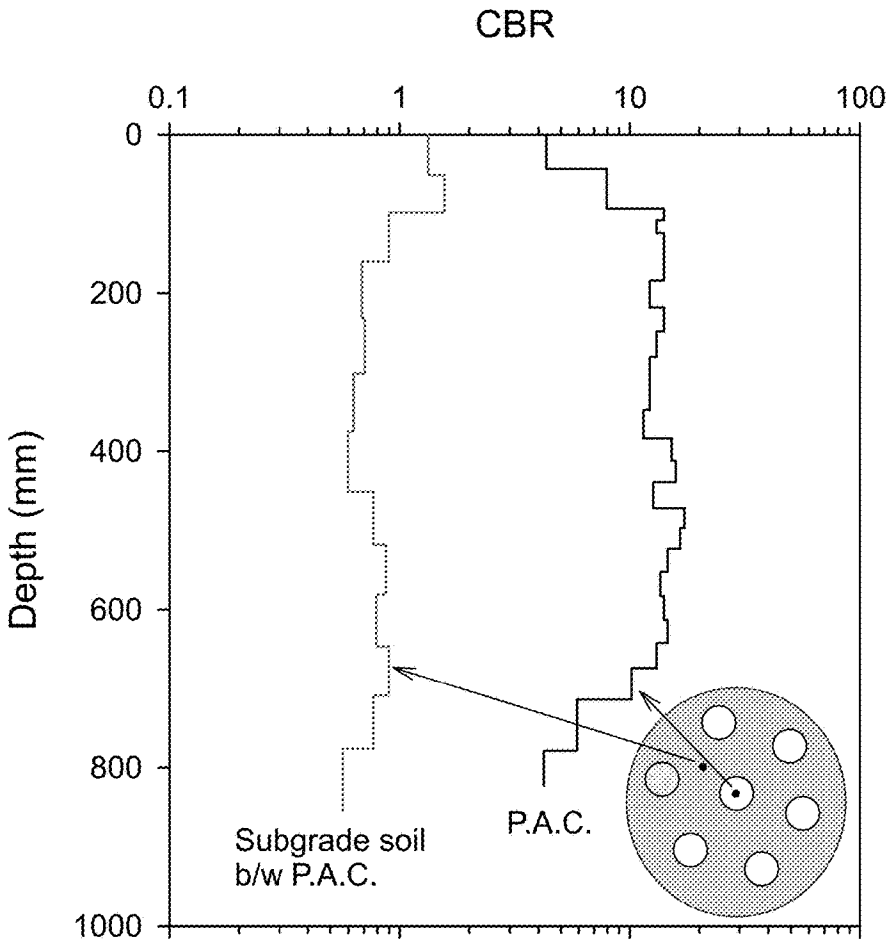
FIGS. 7A and 7B are graphs showing dynamic cone penetration resistance experimental results.
Figure 7B:
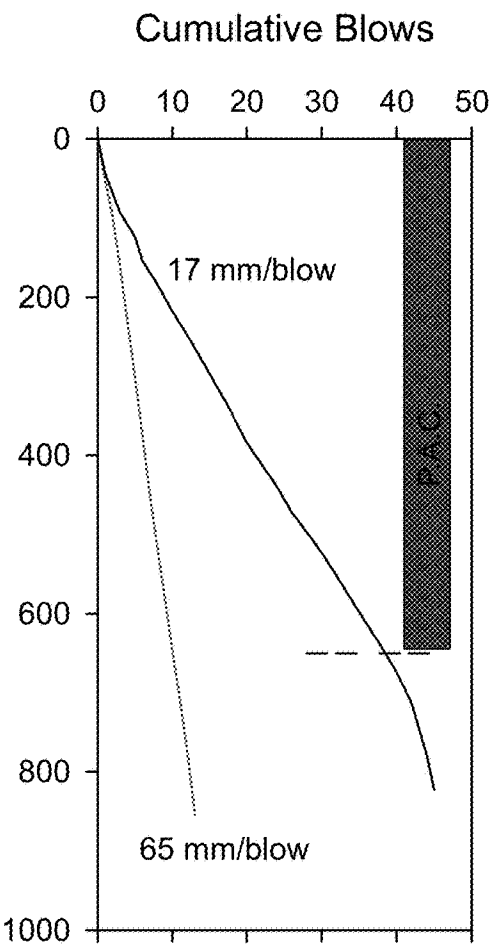

FIGS. 7A and 7B are graphs showing DCP penetration resistance experimental results. Particularly, FIG. 7A shows California Bearing Ratio (CBR) versus depth and the significant improvement in CBR value within the pressed aggregate-filled concavities compared to the existing subgrade soil. CBR is a measurement of stiffness and shear strength of the ground. FIG. 7B shows cumulative blows versus depth and shows that the penetration resistance is increased in the pressed aggregate-filled concavities compared to the subgrade soil.

Figure 8A:
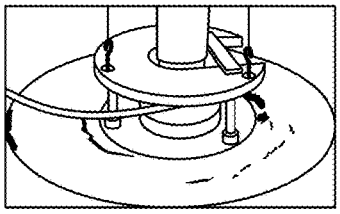
FIG. 8A is an image showing a cyclic plate load test with a 12 inch diameter plate.
Figure 8B:
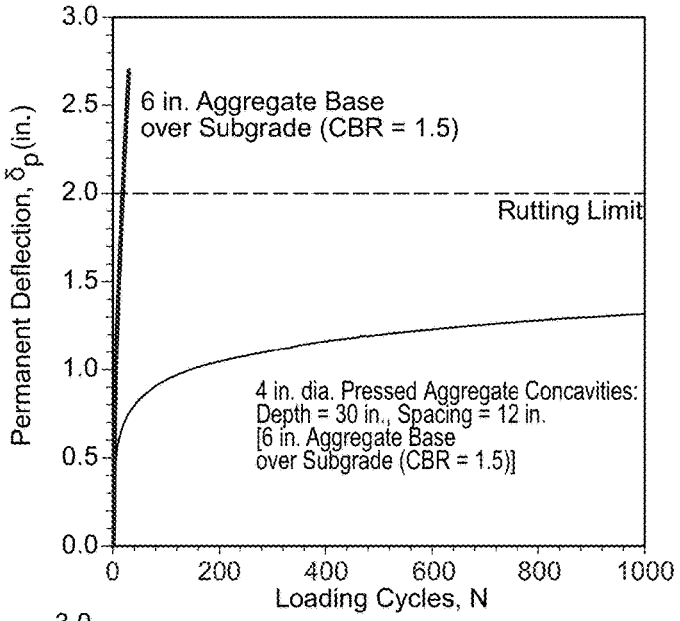
FIGS. 8B and 8C are graphs showing dynamic cone penetration resistance experimental results.
Figure 8C:
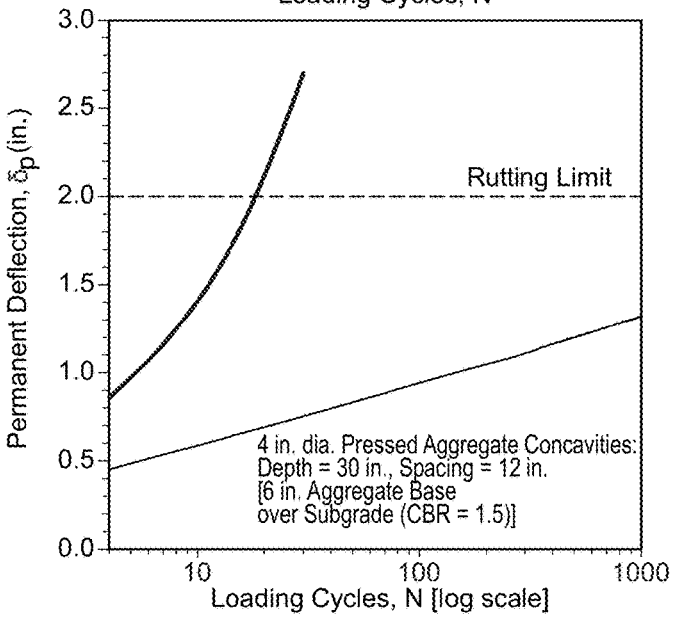

FIG. 8A is an image showing a cyclic (repeated pulse loading to simulate transient pavement or rail car loading) plate load test with a 12 inch diameter plate. The figure also shows the pressed aggregate-filled concavity reinforced ground reduced deformation under loading. FIGS. 8B and 8C are graphs showing permanent deflection versus loading cycles normally and on a logarithmic scale. Here the unreinforced ground deformation increased linearly with increasing loading cycles whereas the pressed aggregate-filled concavity reinforced ground permanent deformation was asymptotic (decreasing rate of deformation with increasing loading cycles and linear on a log scale) indicating that the improved ground was because stiffer with increasing loading.

Figure 9:
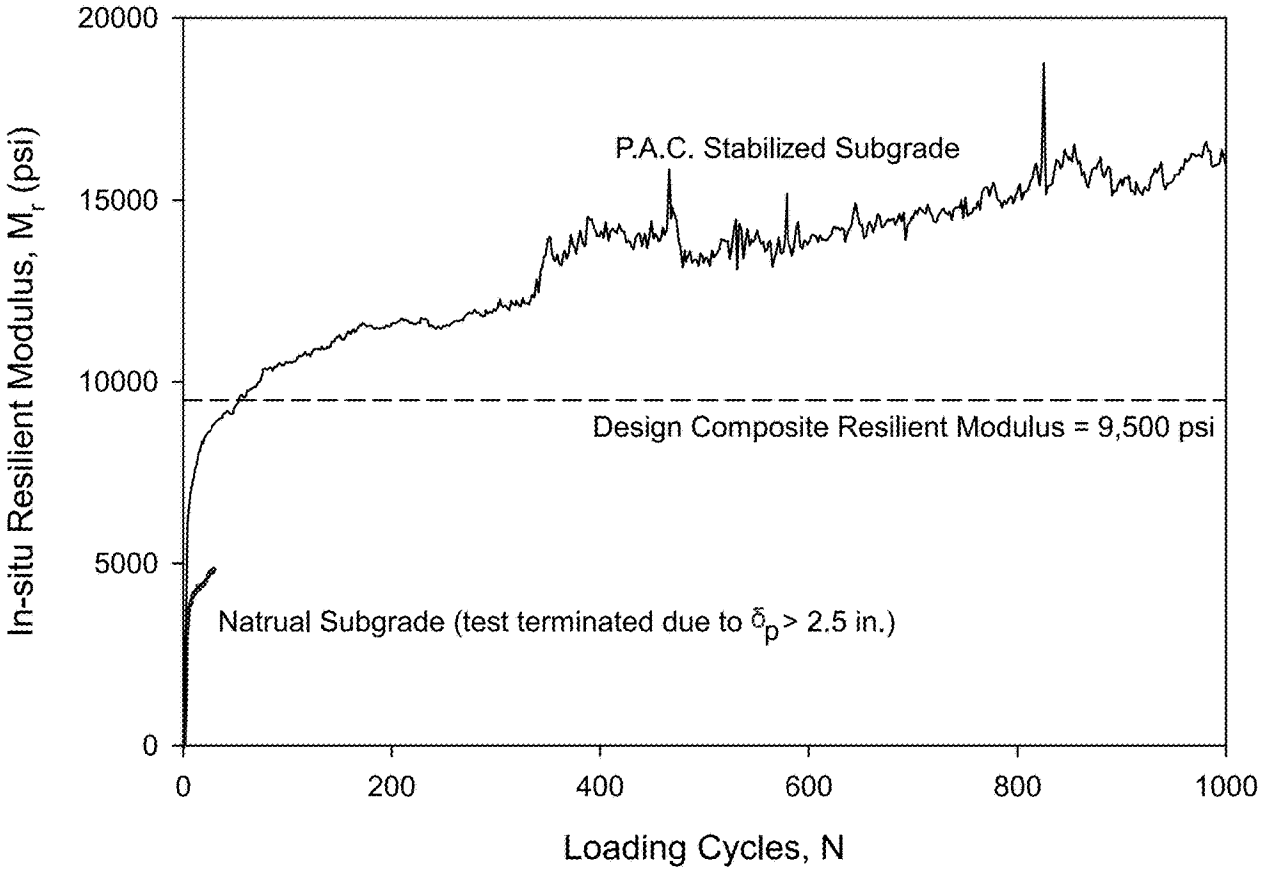
FIG. 9 is a graph depicting resilient modulus.

FIG. 9 is a graph depicting resilient modulus. It is noted that the surface was not re-compacted prior to testing results. This suggests resilient modulus is increasing due to compaction during the testing. Compared to the natural subgrade, the pressed aggregate-filled concavity improved ground was much stiffer.

Figure 10:
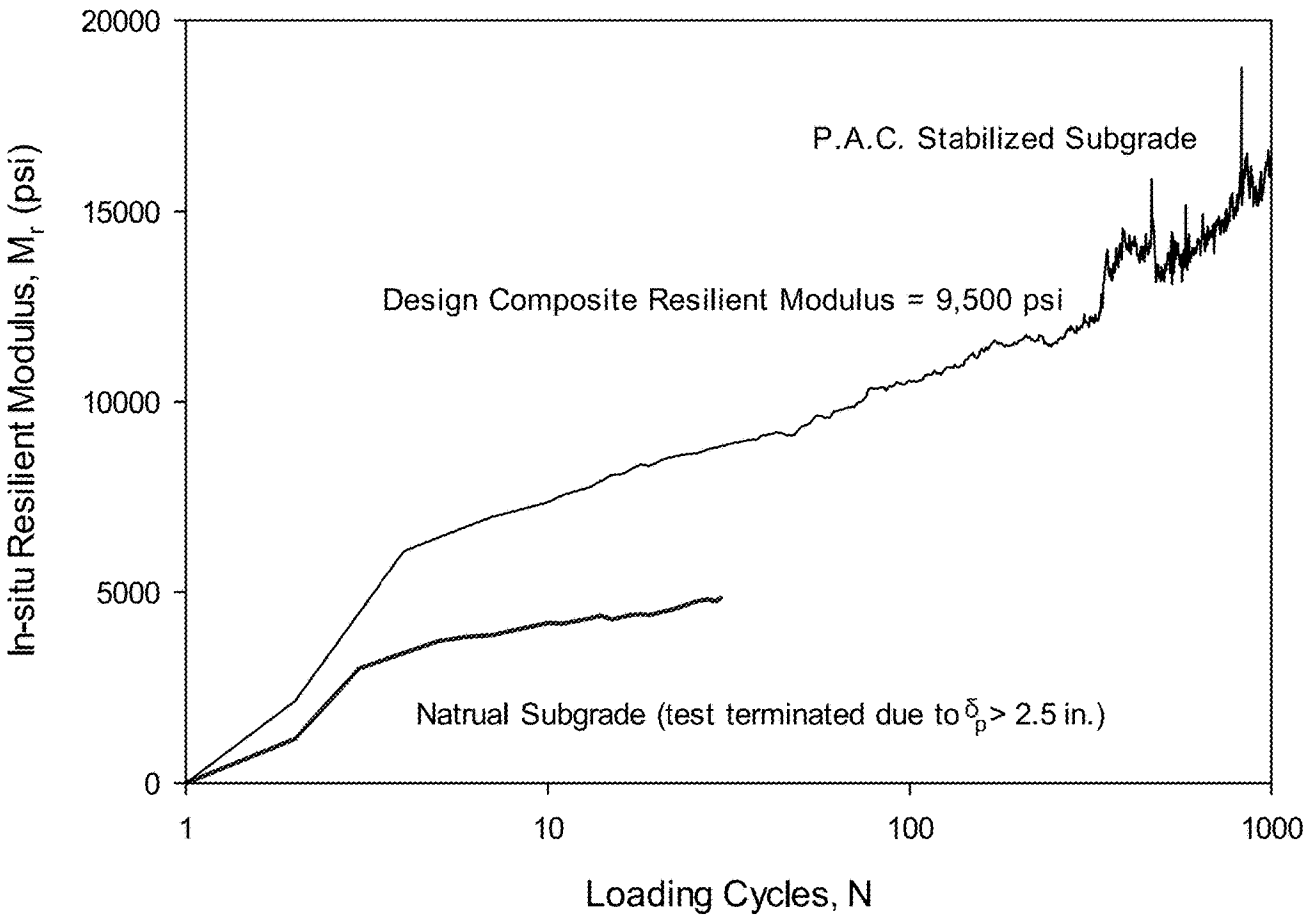
FIG. 10 is another graph depicting resilient modulus.

FIG. 10 is another graph depicting resilient modulus but with the horizontal axis plotted on a log scale. The data from FIG. 9 is used for this figure.

FIG. 11 is a table that compares testing results of an untreated ground surface and a PAC ground surface. Referring to FIG. 11, the pressed aggregate-filled concavity improvement ratio indicates the magnitude of improvement for selected engineering properties relative to the natural subgrade.

Figure 12C:
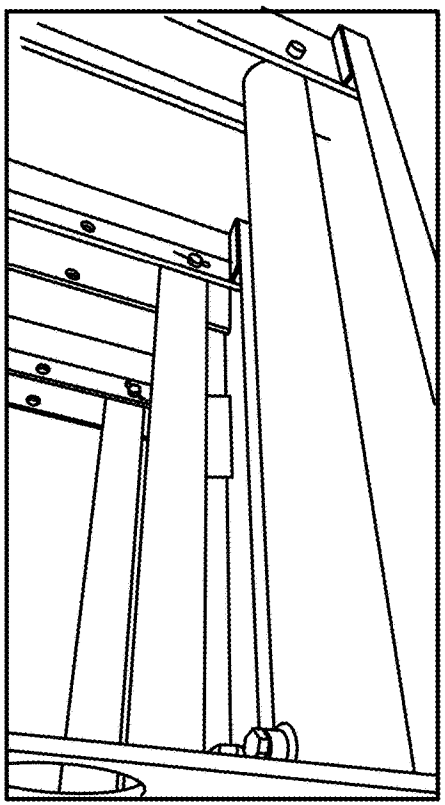
FIGS. 12A-12C are images of a system for providing aggregate filled concavities in accordance with embodiments of the present disclosure.
Figure 12B:
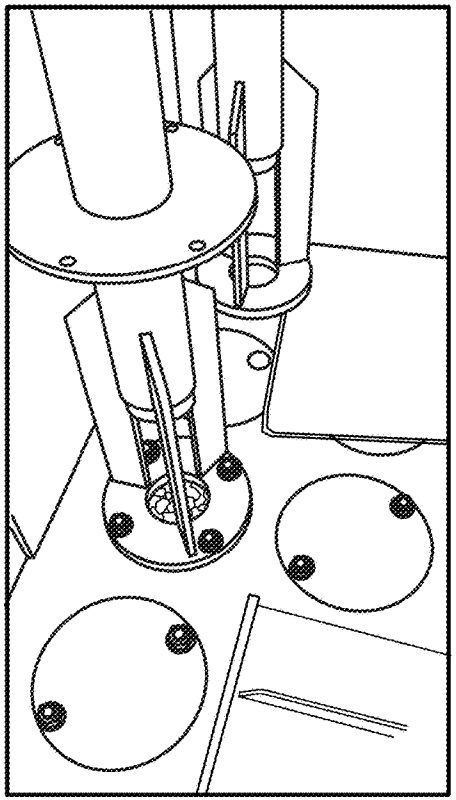
Figure 12A:
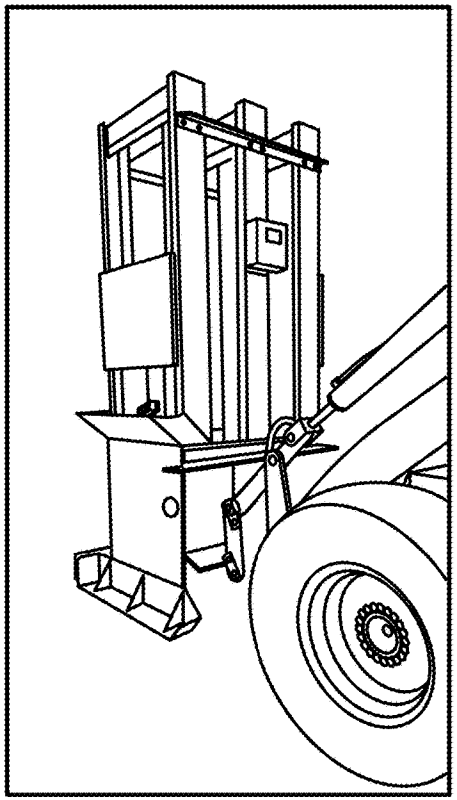

FIGS. 12A-12C are images of a system for providing aggregate filled cavities in accordance with embodiments of the present disclosure. Referring to FIGS. 12A-12C, the system includes multiple mandrels configured to be moved in a downward direction. In addition, the system includes a support configured to carry the mandrels. The system also includes a mechanism attached to the support and mandrels, and configured to move the mandrels in the downward direction. Aggregate, soil, or sand or chemically stabilized soil, sand, or aggregate can be carried near openings such that the aggregate, soil, or sand falls downward through the openings when one or more of the mandrels are lifted upward above a respective opening.

Figure 13B:
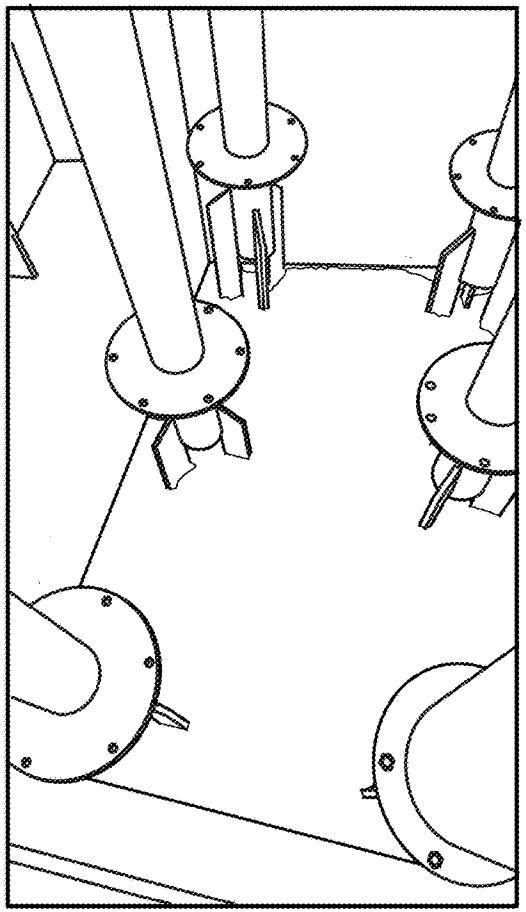
FIGS. 13A and 13B are additional images of the system shown in FIGS. 12A-12C.
Figure 13A:
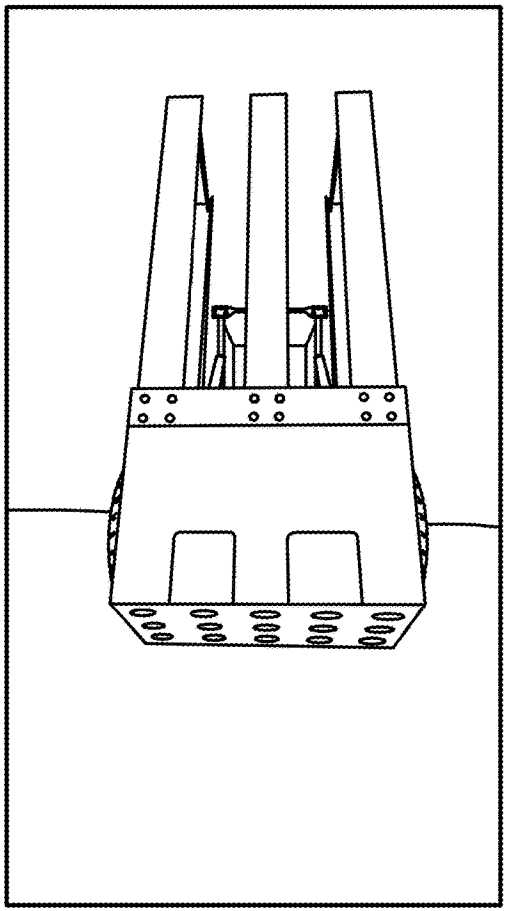

FIGS. 13A and 13B are additional images of the system shown in FIGS. 12A-12C. FIG. 13A shows the system being lifted and moved for placement on a ground surface for use. FIG. 13B shows an interior of a support component of the system for carrying aggregate. Also, the figure shows opening defined in the support through which the mandrels and aggregate may pass.

Figure 14B:
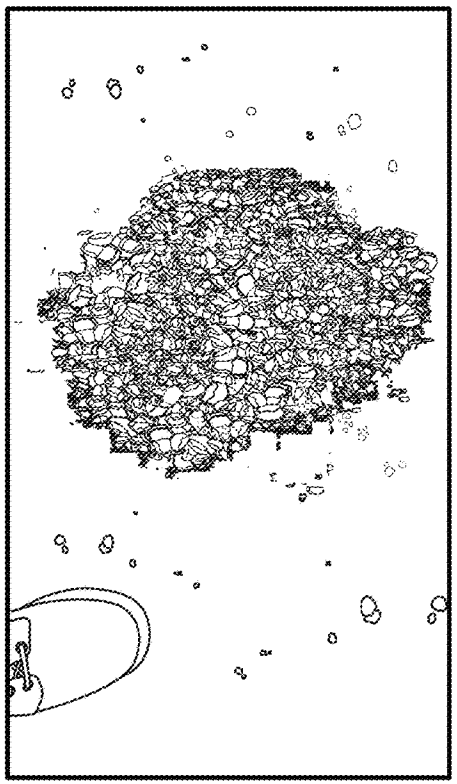
FIG. 14B is an image showing a concavity filled with pressed aggregate to the top of the concavity in accordance with embodiments of the present disclosure.
Figure 14A:
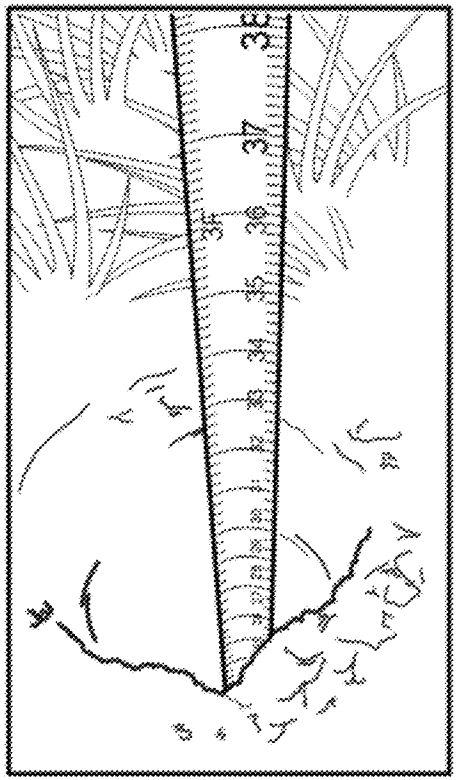
FIG. 14A is an image showing a tape measure being used to measure a depth of a concavity formed by a method in accordance with embodiments of the present disclosure.

FIG. 14A is an image showing a tape measure being used to measure a depth of a concavity formed by a method in accordance with embodiments of the present disclosure.

FIG. 14B is an image showing a concavity filled and pressed with aggregate to the top of the concavity in accordance with embodiments of the present disclosure.

Figure 15B:
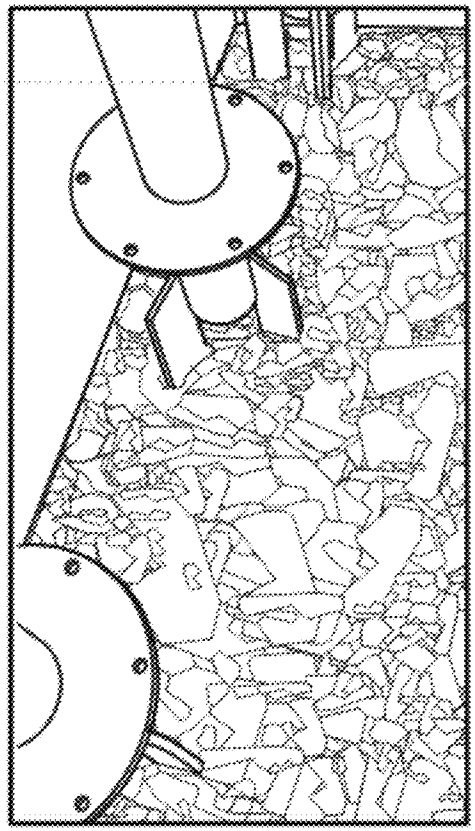
FIGS. 15A and 15B are additional images of the system shown in FIGS. 12A-12C, 13A, and 13B.
Figure 15A:
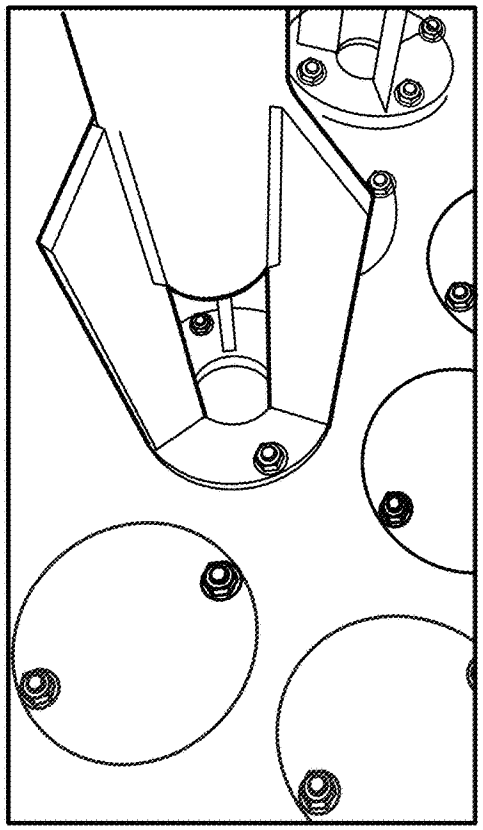

FIGS. 15A and 15B are additional images of the system shown in FIGS. 12A-12C, 13A, and 13B.

The system of claim 16, further comprising a controller configured to individually control pressure applied to the mandrels for movement in the downward direction.

In accordance with embodiments, a system such as the system shown in FIGS. 12A-12C, 13A, 13B, 15A, and 15B may include a controller suitably configured with the mandrels for controlling downward forces applied to the mandrels. For example, the controller may be configured to apply downward forces to the mandrels such that spatially uniform conditions are provided in a ground surface to which the mandrels are applied. It is noted that the mandrels have different lengths (e.g., 3 to 6 ft) and end shapes. The end tool used to form the concavities and subsequently press aggregate into the concavities can have the shape of a flat circular plate, a square plate, the like, or any other suitable shape. Further, the shape can be spherical or hollow straight or tapered pipe (geometry of conical frustum with narrowing diameter toward the top).

In an example, the controller may determine an applied load on the mandrels and displacement of the mandrels; and determine a stiffness of a ground surface to which the mandrels are applied by the determined applied load and the displacement. The control system is controlled using hydraulic components (solenoids) and electrical controls and a programmable software tool to automate operations. A remote tether unit or radio remote control unit is provided to the machine operator to initiate and stop action. Running in the automatic mode the system controls the hydraulic pressure, loading duration, and/or position of the hydraulic cylinders.

Figure 16:
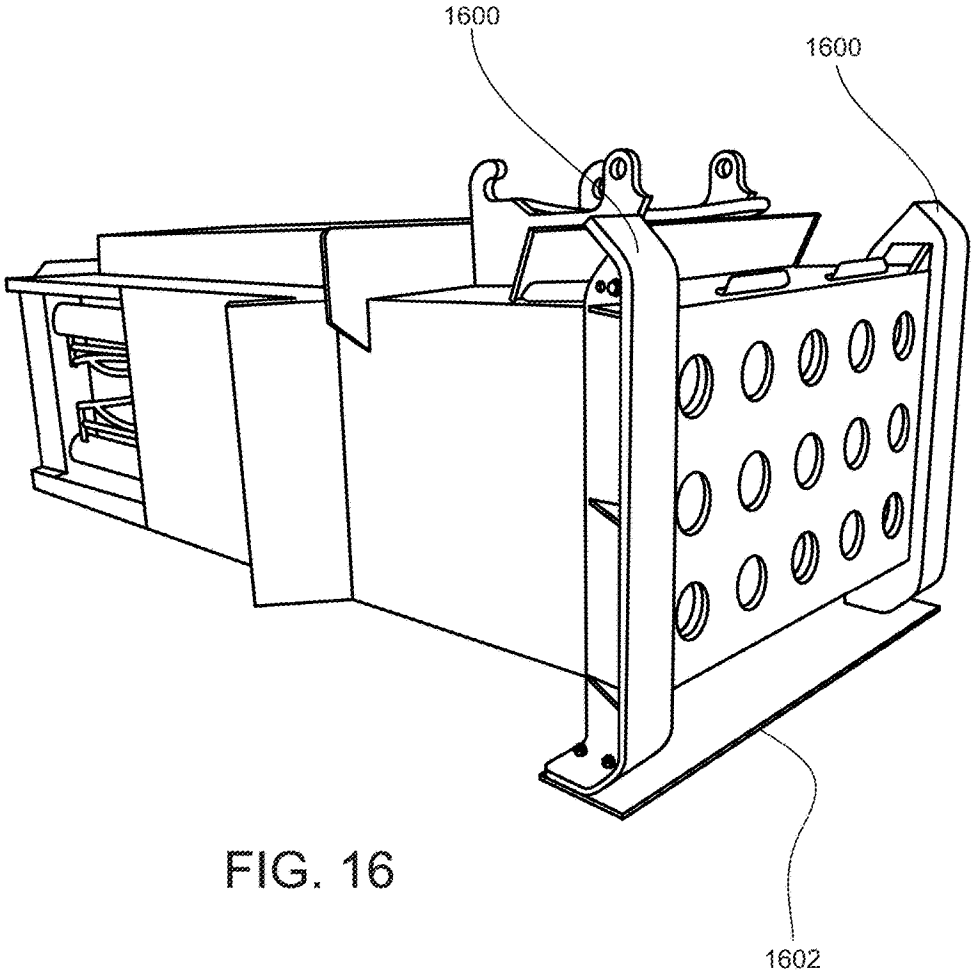
FIG. 16 is another image of the system shown in FIGS. 12A-12C, 13A, 13B, 15A, and 15B.

FIG. 16 is another image of the system shown in FIGS. 12A-12C, 13A, 13B, 15A, and 15B. Attached to the bottom of the system are adjustable skids 1600) that position the system at or above the ground surface (up to 6 inches) and allow the unit to be dragged across the surface. Further, an adjustable strike plate 1602 that acts to provide a flat surface after installing the pressed aggregate-filled concavities and dragging the system on the skids to the next installation location.

In accordance with embodiments of the present disclosure, a system and method as disclosed herein can be configured to penetrate the space between railroad ties both inside and outside of the space between the rails for improvement of existing railroad track beds.

Features from one embodiment or aspect may be combined with features from any other embodiment or aspect in any appropriate combination. For example, any individual or collective features of method aspects or embodiments may be applied to apparatus, system, product, or component aspects of embodiments and vice versa.

While the embodiments have been described in connection with the various embodiments of the various figures, it is to be understood that other similar embodiments may be used or modifications and additions may be made to the described embodiment for performing the same function without deviating therefrom. Therefore, the disclosed embodiments should not be limited to any single embodiment, but rather should be construed in breadth and scope in accordance with the appended claims. One skilled in the art will readily appreciate that the present subject matter is well adapted to carry out the objects and obtain the ends and advantages mentioned, as well as those inherent therein. The present examples along with the methods described herein are presently representative of various embodiments, are exemplary, and are not intended as limitations on the scope of the present subject matter. Changes therein and other uses will occur to those skilled in the art which are encompassed within the spirit of the present subject matter as defined by the scope of the claims.

What is claimed is:

1. A method comprising:

independently controlling each mandrel of a plurality of mandrels to press into a ground surface in a downward direction to create concavities;

providing a support configured to carry the mandrels, wherein the support defines a plurality of openings positioned for allowing the mandrels to pass through respective openings when moved in the downward direction;

filling the concavities with unstabilized or chemically stabilized aggregate, soil, or sand; and using the plurality of mandrels to press the aggregate within the concavities.

2. The method of claim 1, wherein independently controlling each mandrel comprises independently pressing each mandrel under controlled downward force.

3. The method of claim 1, wherein independently controlling each mandrel comprises pressing each mandrel independently of one another under controlled vertical displacement.

4. The method of claim 1, wherein independently controlling each mandrel comprises placing the plurality of mandrels in the concavities, and wherein the method further comprises removing the plurality of mandrels from the concavities.

5. The method of claim 1, further comprising repeating the steps of filling the concavities with aggregate, and independently controlling each mandrel to press the aggregate, soil, or sand within the each concavity.

6. The method of claim 5, wherein repeating the steps comprises repeating the steps until the plurality of mandrels do not settle under applied pressure near the top of the ground surface or base of the aggregate, soil, or sand.

7. The method of claim 5, wherein the measurement of force and displacement from the action of pressing the aggregate is used to determine the stiffness of the ground and from installing the pressed-aggregate concavities.

8. The method of claim 1, further comprising using a hollow pipe to push the aggregate, soil, or sand to a lower depth in the concavity where it remains after the plurality of mandrels are extracted from the concavity.

9. The method of claim 1, wherein independently controlling each mandrel comprises independently controlling each mandrel to press into a ground surface such that a predetermined stiffness across the ground surface results.

10. The method of claim 1, further comprising measuring uniformity and stiffness of the ground surface, and wherein independently controlling each mandrel comprises independently controlling each mandrel to press into a ground surface based on the measured uniformity and stiffness such that a predetermined stiffness across the ground surface results.

11. A method comprising:

independently controlling each mandrel of a plurality of mandrels to press into different portions of a ground surface in downward directions to create a plurality of cavities;

providing a support configured to carry the mandrels, wherein the support defines a plurality of openings positioned for allowing the mandrels to pass through respective openings when moved in the downward direction;

filling the cavities with unstabilized or chemically stabilized aggregate, soil, or sand; and using the mandrels to press the unstabilized or chemically stabilized aggregate, soil, or sand within the cavities.

12. The method of claim 11, wherein independently controlling each mandrel comprises using a plurality of spaced-apart mandrels to press into the different portions of the ground surface.

13. The method of claim 11, wherein independently controlling each mandrel comprises pressing each mandrel with independent controlled downward force.

14. The method of claim 11, wherein independently controlling each mandrel comprises placing the different mandrels in respective cavities, and wherein the method further comprises removing the mandrels from the respective cavities.

15. The method of claim 11, further comprises repeating the steps of filling the cavities with aggregate, soil, or sand, and independently controlling each mandrel to press the aggregate, soil, or sand within the cavities.

16. The method of claim 15, wherein repeating the steps comprises repeating the steps until the mandrels do not settle under applied pressure near the top of the ground surface or base of the aggregate, soil, or sand.

17. The method of claim 11, wherein a diameter of each of the cavities is between 3 inches and 12 inches.

18. The method of claim 11, further comprising covering a top of the aggregate, soil, or sand with additional aggregate subsequent to pressing the aggregate, soil, or sand within the cavities.

19. The method of claim 11, wherein the measurement of force and displacement from the action of pressing the aggregate is used to determine the stiffness of the ground and from installing the pressed-aggregate concavities.

20. A system comprising:

a plurality of mandrels configured to each be controlled independently of one other to move in a downward direction;

a support configured to carry the mandrels, wherein the support defines a plurality of openings positioned for allowing the mandrels to pass through respective openings when moved in the downward direction; and a mechanism attached to the support and mandrels, and configured to independently move each of the mandrels in the downward direction.

21. The system of claim 20, wherein the mandrels are spaced apart.

22. The system of claim 20, wherein the mechanism is configured to apply a controlled downward force to each mandrel independent of one another for creating a plurality of cavities in a ground surface.

23. The system of claim 20, wherein the mechanism is configured to apply a controlled downward displacement to each mandrel independently of one another for creating a plurality of cavities in a ground surface.

24. The system of claim 20, wherein the support is configured to carry unstabilized or chemically stabilized aggregate, soil, or sand.

25. The system of claim 20, wherein the aggregate, soil, or sand is carried near the openings such that the aggregate, soil, or sand falls downward through the openings when one or more of the mandrels are lifted upward above a respective opening.

26. The system of claim 20, wherein an underside of the support is flat.

27. The system of claim 20, further comprising a controller configured to individually control pressure applied to the mandrels for movement in the downward direction.

28. The system of claim 27, wherein the controller is configured to apply pressures to the mandrels such that spatially uniform conditions are provided in a ground surface to which the mandrels are applied.

29. The system of claim 28, wherein the mandrels have different lengths.

30. The system of claim 20, further comprising a controller configured to:

determine an applied load on the mandrels and displacement of the mandrels; and determine a stiffness of a ground surface to which the mandrels are applied by the determined applied load and the displacement.

31. The system of claim 20, wherein the mandrels have a shape that is one of a flat circular plate, a square plate, a spherical shape, or a hollow straight or tapered pipe.

32. A system comprising:

a plurality of mandrels configured to each be controlled independently of one other to move in a downward direction;

a support configured to carry the mandrels;

a mechanism attached to the support and mandrels, and configured to independently move each of the mandrels in the downward direction; and one or more skids attached to an underside of the support.

* * * * *